US006676390B2

(12) United States Patent
Wang

(10) Patent No.: US 6,676,390 B2
(45) Date of Patent: Jan. 13, 2004

(54) MANUAL AIR PUMP INCORPORATING A FOOT SWITCH IN THE BASE MEMBER

(76) Inventor: Ta-Chin Wang, 17-2 Fl., No. 457, Cheng-Kung Rd., Tainan (TW)

( * ) Notice: Subject to any disclaimer, the term of this patent is extended or adjusted under 35 U.S.C. 154(b) by 65 days.

(21) Appl. No.: 10/079,298

(22) Filed: Feb. 18, 2002

(65) Prior Publication Data

US 2003/0156960 A1 Aug. 21, 2003

(51) Int. Cl.[7] ..... F04B 1/00
(52) U.S. Cl. ..... 417/528; 417/468; 417/521
(58) Field of Search ..... 417/528, 468, 417/521; 280/201

(56) References Cited

U.S. PATENT DOCUMENTS 1,484,549 A * 2/1924 Burnam ..... 417/528
4,508,490 A * 4/1985 Ramirez et al. ..... 417/234
5,997,256 A * 12/1999 Gunther ..... 417/528
6,027,319 A * 2/2000 Winefordner et al. ..... 417/468
6,371,741 B1 * 4/2002 Wu ..... 417/468
6,428,290 B1 * 8/2002 Wang ..... 417/521

* cited by examiner

*Primary Examiner*—Cheryl J. Tyler
(74) *Attorney, Agent, or Firm*—Dellett & Walters

(57) ABSTRACT

A manual air pump with a handle includes a base member, a foot switch, an outlet cylinder, an inner cylinder and a pumping assembly. The foot switch is mounted on the base member. The outlet cylinder is mounted vertically on the base member. The inner cylinder is mounted vertically on the base member in the outer cylinder. The pumping assembly is moveably mounted in the outer cylinder and securely attached to the inner cylinder. Multiple check valves are mounted in the cylinders and the base member to form two stages to pump the air into the object to be inflated in a great quantity when the object to be inflated is in a low-pressure condition and easily pump compressed air into the object to be inflated when the object to be inflated is in a high-pressure condition.

4 Claims, 4 Drawing Sheets

MANUAL AIR PUMP INCORPORATING A FOOT SWITCH IN THE BASE MEMBER

BACKGROUND OF THE INVENTION

1. Field of the Invention

The present invention relates to an air pump, and more particularly to a manual air pump with a handle.

2. Description of Related Art

A conventional manual air pump with a handle in accordance with the prior art only has one piston. A single-cylinder air pump, for example, comprises a base member, a cylinder, a shaft, a piston, a handle, a check valve, a discharge tube and a nipple. The base member has a fixed pedal on which the user steps to hold the air pump in place. The cylinder is mounted vertically on the base member. A shaft is moveably mounted in the cylinder. The shaft has a first end moveably mounted in the cylinder and a second end extending out from the cylinder. The piston is mounted on the first end of the shaft, and the handle is mounted on the second end of the shaft so a user can reciprocate the piston in the cylinder. The check valve is mounted on the base member. The discharge tube is mounted on the base member and corresponds to the check valve. The nipple is mounted on a free end of the discharge tube.

The nipple is adapted to connect to an object to be inflated. The piston is moved upward in the cylinder to draw air into the cylinder from outside the pump. The piston is moved downward to pump the air in the cylinder into the object to be inflated. However, the flow rate of the conventional manual air pump with a handle is low. Furthermore, the pressure in the inflated object gradually becomes higher and provides a greater resistance to the air pump, and the user must apply more force to pump air into the inflated object. Consequently, the conventional manual air pump with a handle needs to be advantageously altered.

The present invention has arisen to mitigate and/or obviate the disadvantages of the conventional.

SUMMARY OF THE INVENTION

The main objective of the manual air pump with a handle in accordance with the present invention is to provide an improved manual air pump with a handle.

To achieve the objective, the manual air pump with a handle in accordance with the present invention comprises a base member, a foot switch, an outlet cylinder, an inner cylinder and a pumping assembly. The base member has a wing plate extending laterally from the base member on which the user steps to hold the manual air pump in place during operation of the pump. The foot switch is mounted on the base member. The outlet cylinder is mounted vertically on the base member. The inner cylinder is mounted vertically on the base member inside the outer cylinder. The pumping assembly moveably mounted in the outer cylinder and receives the inner cylinder. Multiple check valves are mounted in the cylinders and the base member to form two stages to pump air into the inflated object in a great quantity when the inflated object is in a low-pressure condition and easily pump compressed air into the inflated object when the inflated object is in a high-pressure condition.

Further benefits and advantages of the present invention will become apparent after a careful reading of the detailed description with appropriate reference to the accompanying drawings.

DETAILED DESCRIPTION OF THE INVENTION

Figure 1:
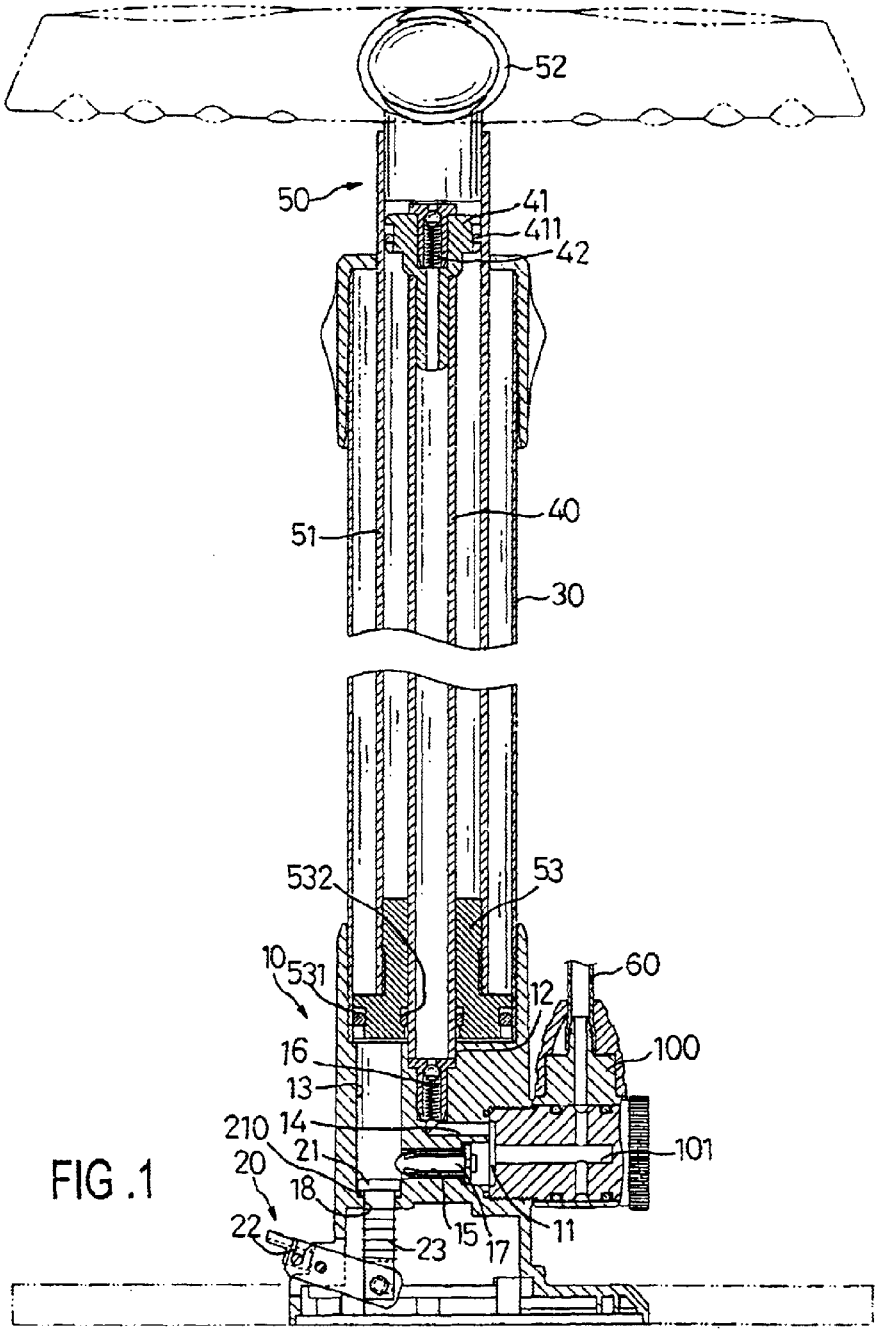
FIG. 1 is a cross sectional side plan view of a manual air pump with a handle in accordance with the present invention.

With reference to the drawings and initially to FIG. 1, a manual air pump with a handle in accordance with the present invention comprises a base member (10), a foot switch (20), an outlet cylinder (30), an inner cylinder (40), a pumping assembly (50) and a discharge tube (60). A wing plate (not shown) extending laterally from the base member (10) is adapted to be stepped on by a user to hold the manual air pump in place during operation of the pump. The foot switch (20) is mounted on the base member (10). The outlet cylinder (30) is mounted vertically on the base member (10). The inner cylinder (40) is mounted vertically on the base member (10) inside the outer cylinder (30). The pumping assembly (50) is moveably mounted in the outer cylinder (30) and is securely attached to the inner cylinder (40). The discharge tube (60) has a first end connected to the base member (10) and a second end with a nipple (not shown) mounted on the discharge tube (60) and adapted to be connected to an object to be inflated (not shown).

An outlet (11) is defined in the base member (10), and a connector (100) is mounted on the base member (10) and corresponds to the outlet (11). A passage (101) is defined in the connector to communicate between the outlet (11) and the discharge tube (60). A first longitudinal path (12) is defined in the base member (10) and communicates with the inner cylinder (40). A second longitudinal path (13) is defined in the base member (10) and communicates with the outer cylinder (30). A first lateral path (14) is defined in the base member (10) and communicates between the first longitudinal path (12) and the outlet (11). A second lateral path (15) is defined in the base member (10) below the first lateral path (14) and communicates between the second longitudinal path (13) and the outlet (11). A first ball check valve (16) is mounted in the first longitudinal path (12) to prevent air pumped out of the inner cylinder (40) from flowing back into the inner cylinder (40) from the outlet (11) via the first lateral path (14) and the first longitudinal path (12). A first check valve (17) is mounted in the second lateral path (15) to prevent air pumped out of the outer cylinder (30) from flowing back into the outer cylinder (30) from the outlet (11) via the second lateral path (15) and the second longitudinal path (13). A through hole (18) is defined in a bottom of the base member (10) and communicates with the second longitudinal path (13).

The foot switch (20) includes a T-shaped actuating rod (21) movably mounted through the through hole (18) and in the second longitudinal path (13). An O-ring (210) is mounted around the actuating rod (21) and selectively abutting the base member (10) to close the through hole (18) in the base member (10) or to selectively separate the second lateral path (15) from the second longitudinal path (13). An actuating lever (22) is pivotally mounted on the base member (10). The lever (22) has a first end extending through the base member (10) and a second end pivotally connected to the actuating rod (21) to move the actuating rod (21) in the through hole (18) and the second longitudinal path (13). A spring (23) is compressively mounted around the actuating rod (21) to provide a restitution force on the actuating rod (21).

The pumping assembly (50) includes a central cylinder (51) mounted around the inner cylinder (40). The central cylinder (51) has a diameter smaller than that of the outer cylinder (30) and greater than that of the inner cylinder (40). A handle (52) is mounted on a first end of the central cylinder (51), and a piston (53) is mounted on a second end of the central cylinder (51). The piston (53) is movable relative to an inner periphery of the outer cylinder (30) and an outer periphery of the inner cylinder (40). A second check valve (531) is mounted around the piston (53) and selectively abuts the inner periphery of the outer cylinder (30) to only allow compressed air to flow downward between the outer cylinder (30) and the central cylinder (51). A third check valve (532) is mounted in the piston (53) and selectively abuts the outer periphery of the inner cylinder (40) to only allow compressed air to flow upward between the outer cylinder (30) and the inner cylinder (40).

A valve block (41) is mounted on top of the inner cylinder (40), and a fourth check valve (411) is mounted around the valve block (41) and selectively abuts an inner periphery of the central cylinder (51) to only allow compressed air to flow upward between the central cylinder (51) and the inner cylinder (40). A second ball check valve (42) is centrally mounted in the valve block (41) to only allow compressed air to flow from the central cylinder (51) above the valve block (41) downward into the inner cylinder (40).

Figure 2:
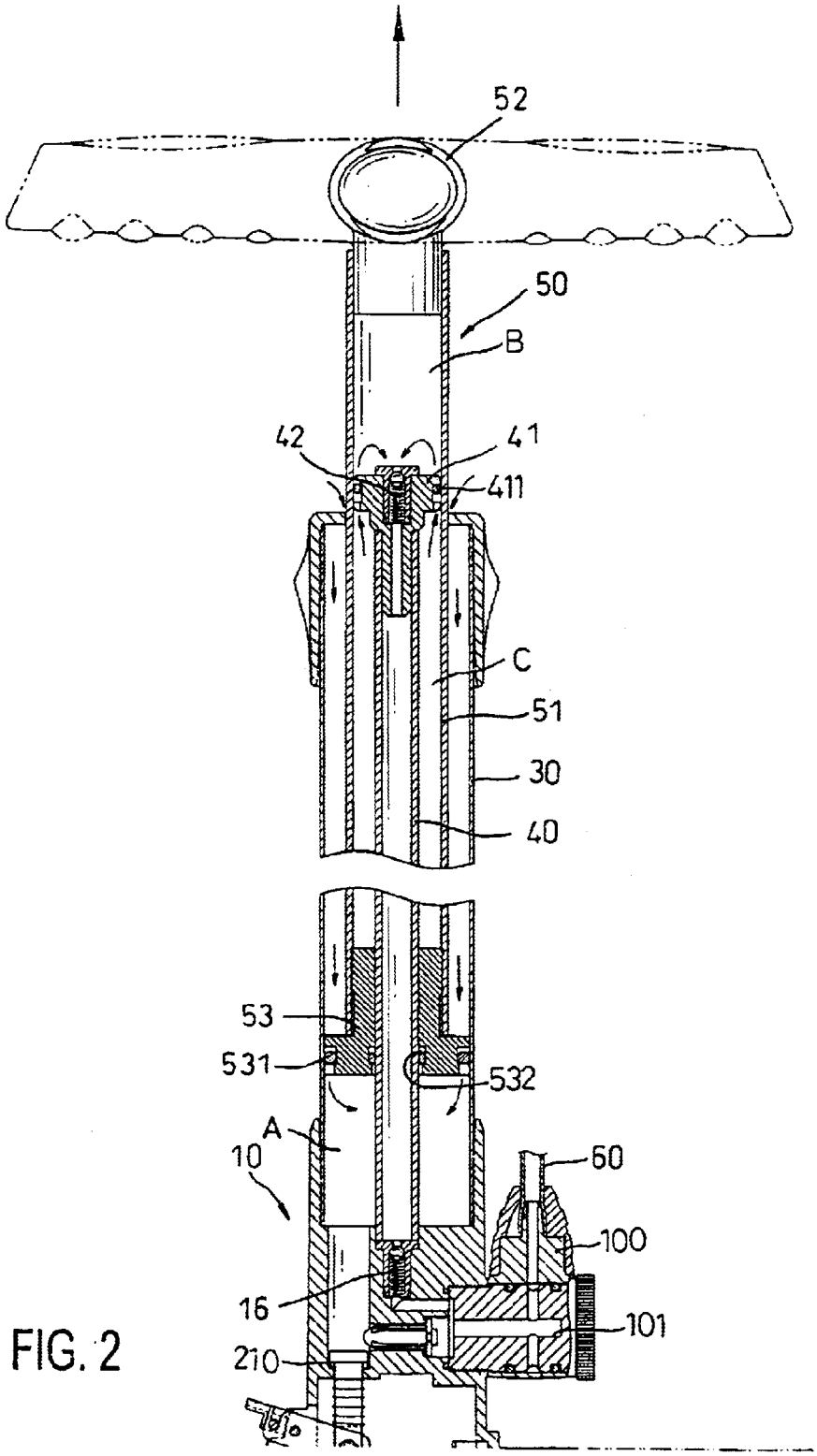
FIG. 2 is an operational cross sectional side plan view of the manual air pump with a handle in FIG. 1 when a central cylinder is pulled upward.

With reference to FIG. 2, the nipple (not shown) on the discharge tube (60) is connected to an object to be inflated before the manual air pump with a handle is operated. When the user pulls the handle (52) and the attached central cylinder (51) upward a vacuum is formed in a first chamber (A) formed between the outer cylinder (30) and the inner cylinder (40). The vacuum draws air from outside the air pump into the first chamber (A) through a gap (not numbered) between the outer cylinder (30) and the central cylinder (51) and further through the second check valve (531). A vacuum is also formed in a second chamber (B) formed in the central cylinder (51) above the valve block (41) so that air in a third chamber (C).formed between the inner cylinder (40) and the central cylinder (51) is drawn into the second chamber (B).

Figure 3:
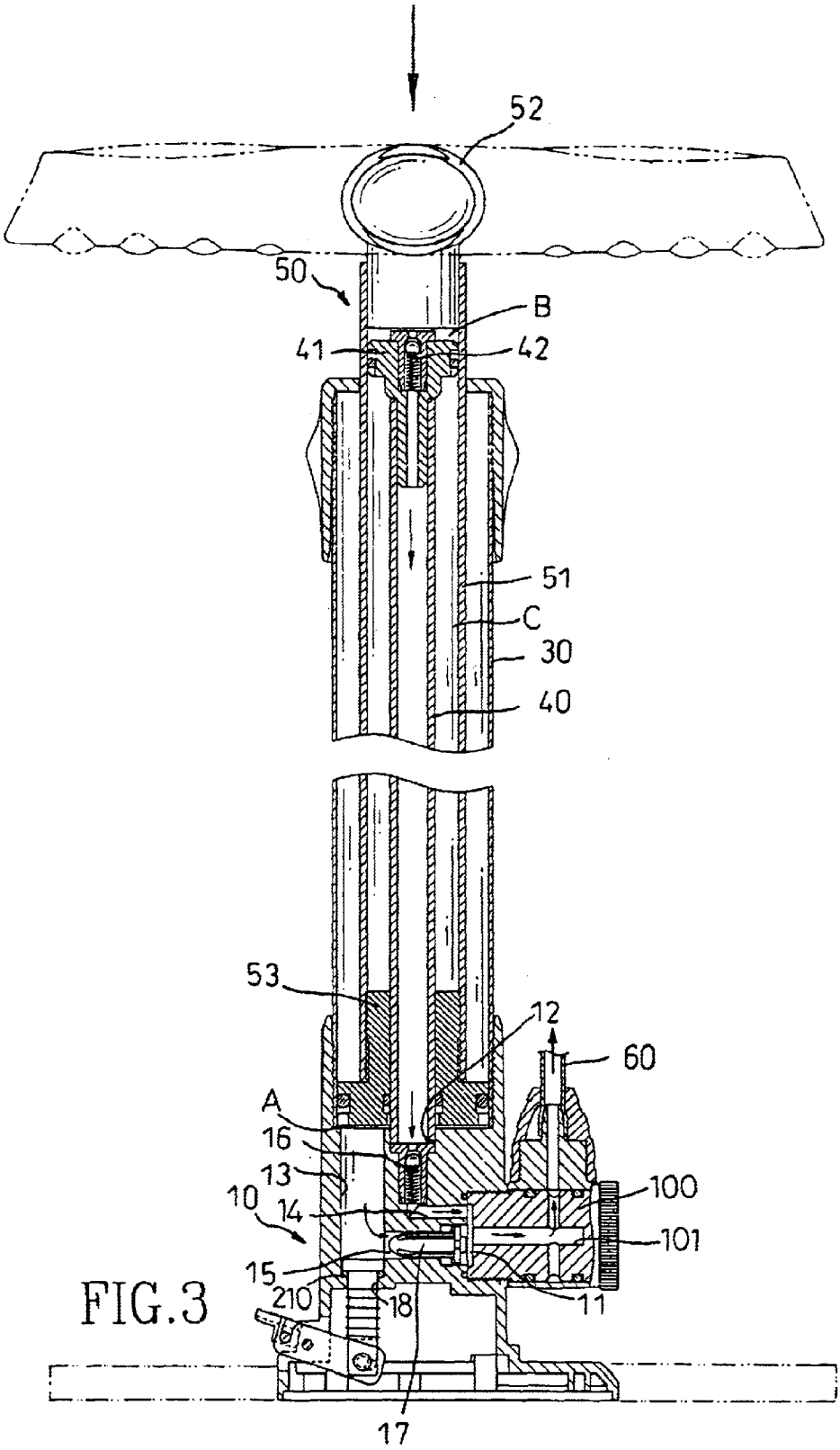
FIG. 3 is an operational cross sectional side plan view of the manual air pump with a handle in FIG. 1 when the central cylinder is pushed downward.

With reference to FIG. 3, when the user pushes the central cylinder (51) downward, the air in the first chamber (A) is compressed and flows through the second lateral path (15) via the first check valve (17) into the outlet (11) and passage (101) in the connector (100). The air is compressed in the second chamber (B), pushes downward, opens the second ball check valve (42) in the valve block (41) and flows into the inner cylinder (40). The compressed air in the inner cylinder (40) downward pushes, opens the first ball check valve (16) and flows into the outlet (11) and passage (101) in the connector (100). The compressed air in the outlet (11) and the passage (101) is pumped into the object to be inflated in a great quantity because the manual air pump is designed to provide two stages for compressing air.

Figure 4:
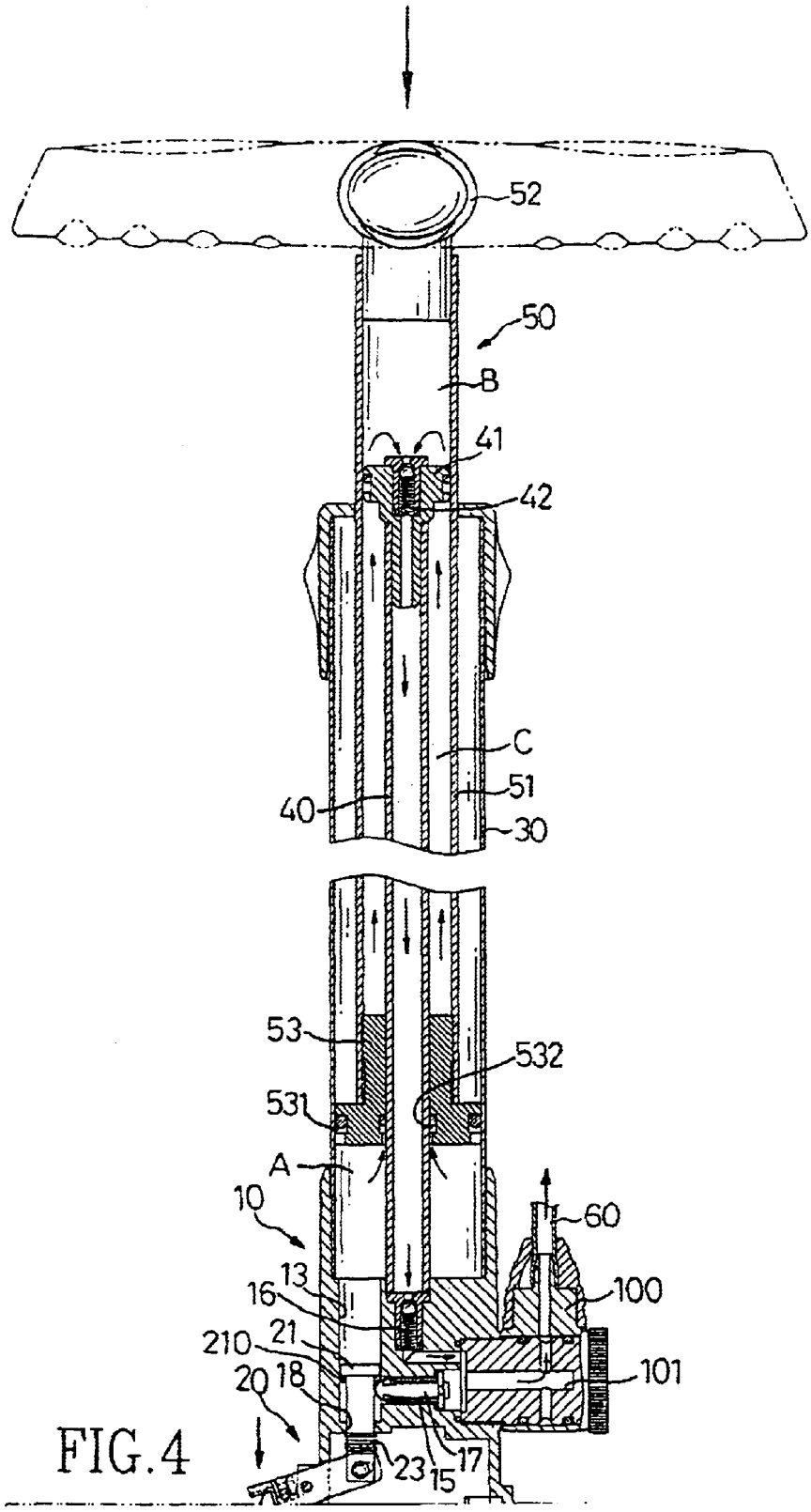
FIG. 4 is an operational cross sectional side plan view of the manual air pump with a handle in FIG. 1 when an actuating lever is pressed down and the central cylinder is pushed downward.

With reference to FIG. 4, when the object to be inflated is in a high-pressure condition and to make the pump operate easier, the user can press the actuating lever (22) downward to make the actuating rod (21) moving upward in the second longitudinal path (13) to close the path between chamber A and the outlet (11). When the central cylinder (51) is pushed downward, the compressed air in the first chamber (A) partially flows out of the manual air pump via the through hole (18) in the base member (10) because the pressure in the through hole (18) is high enough to open the first check valve (17), and partially flows into the third chamber (C) via the third check valve (532). Consequently, the user can easily push the central cylinder (51) down because the compressed air in the first chamber (A) drains from the through hole (18). Furthermore, with reference to FIGS. 1–4, the diameter of the cylinder (51) is much greater than that of the inner cylinder (40) so that the manual air pump with a handle can provide high-pressure compressed air to an object to be inflated.

As described, the manual air pump with a handle can pump a great quantity of compressed air to the object to be inflated when the inflated object is in a low-pressure condition and can easily pump compressed air into the object to be inflated when the object to be inflated is in a high-pressure condition. Consequently, the manual air pump with a handle in accordance with the present invention obviates the disadvantages of the conventional manual air pump with a handle.

Although the invention has been explained in relation to its preferred embodiment, it is to be understood that many other possible modifications and variations can be made without departing from the spirit and scope of the invention as hereinafter claimed.

What is claimed is:

1. A manual air pump with a handle comprising a base member, a foot switch mounted on the base member, an outer cylinder mounted vertically on the base member, an inner cylinder mounted vertically on the base member inside the outer cylinder, a pumping assembly moveably mounted in the outer cylinder and securely attached to the inner cylinder, wherein the base member with a wing plate extends laterally from the base and is adapted to be stepped on by a user to hold the manual air pump in place during operation of the pump, and includes:

an outlet defined in the base member to provide compressed air to a discharge tube that is adapted to be connected to an object to be inflated;

a first longitudinal path centrally defined in the base member;

a second longitudinal path defined in the base member;

a first lateral path defined in the base member and communicating between the outlet and the first longitudinal path;

a second lateral path defined in the base member and communicating between the outlet and the second longitudinal path;

a first ball check valve mounted in the first longitudinal path to prevent compressed air from flowing back from the outlet; and a first check valve mounted in the second lateral path to prevent compressed air from flowing back from the outlet into the second longitudinal path;

the foot switch is partially received in the second longitudinal path to selectively separate the second lateral path and the second longitudinal path;

the outer cylinder communicates with the second longitudinal path in the base member;

the pumping assembly includes:

a central cylinder mounted around the inner cylinder, the central cylinder having a diameter smaller than that of the outer cylinder and greater than that of the inner cylinder, the central cylinder having a first end extending out of the outer cylinder and a second end mounted in the outer cylinder;

a handle mounted on the first end of the central cylinder (51) for the user to drive the pumping assembly;

a piston mounted on the second end of the central cylinder, the piston being movable relative to an inner periphery of the outer cylinder and an outer periphery of the inner cylinder;

a second check valve mounted around the piston and selectively abutting the inner periphery of the outer cylinder to only allow compressed air to flow downward between the outer cylinder and the central cylinder; and a third check valve mounted in the piston and selectively abutting the outer periphery of the inner cylinder to only allow compressed air to flow upward between the outer cylinder and the inner cylinder;

the inner cylinder includes a valve block mounted on a top of the inner cylinder and a fourth check valve mounted around the valve block and selectively abutting an inner periphery of the central cylinder to only allow compressed air to flow upward between the central cylinder and the inner cylinder; and a discharge tube has a first end communicating with the outlet in the base member and a second end adapted to be connected to a object to be inflated.

2. The manual air pump with a handle as claimed in claim 1, wherein the base member includes a through hole defined in the base member to communicate with the second longitudinal path in the base member, and the foot switch includes:

a T-shaped actuating rod movably mounted through the through hole and in the second longitudinal path;

an O-ring mounted around the T-shaped actuating rod and selectively abutting the base member to selectively close the through hole in the base member and to selectively separate the second lateral path from the second longitudinal path;

an actuating lever pivotally mounted on the base member, the actuating lever having a first end extending through the base member and a second end pivotally connected to the T-shaped actuating rod to move the actuating rod in the through hole and the second longitudinal path; and a spring compressively mounted around the actuating rod to provide a restitution force on the T-shaped actuating rod.

3. The manual air pump with a handle as claimed in claim 2, wherein the base member comprises a connector having a passage defined to communicate with the outlet in the base member and the first end on the discharge tube communicates with the passage in the connector.

4. The manual air pump with a handle as claimed in claim 1, wherein the base member comprises a connector having a passage defined to communicate with the outlet in the base member and the first end on the discharge tube communicates with the passage in the connector.

* * * * *